US009790959B2

(12) United States Patent
Briand

(10) Patent No.: US 9,790,959 B2
(45) Date of Patent: Oct. 17, 2017

(54) AXIAL FLOW COOLING FAN WITH CENTRIPETALLY GUIDING STATOR VANES

(71) Applicant: SDMO Industries, Brest (FR)

(72) Inventor: Marcel Briand, Plougastel Daoulas (FR)

(73) Assignee: SDMO INDUSTRIES, Brest (FR)

( * ) Notice: Subject to any disclaimer, the term of this patent is extended or adjusted under 35 U.S.C. 154(b) by 323 days.

(21) Appl. No.: 14/396,702

(22) PCT Filed: Apr. 26, 2013

(86) PCT No.: PCT/EP2013/058698

§ 371 (c)(1),
(2) Date: Oct. 23, 2014

(87) PCT Pub. No.: WO2013/160432

PCT Pub. Date: Oct. 31, 2013

(65) Prior Publication Data

US 2015/0125287 A1 May 7, 2015

(30) Foreign Application Priority Data

Apr. 26, 2012 (FR) ..... 12 53889

(51) Int. Cl.
*F04D 29/54* (2006.01)
*F01P 5/06* (2006.01)
*F04D 19/00* (2006.01)

(52) U.S. Cl.
CPC ..... *F04D 29/544* (2013.01); *F01P 5/06* (2013.01); *F04D 19/002* (2013.01); *F04D 29/542* (2013.01); *F01P 2070/50* (2013.01)

(58) Field of Classification Search
CPC .... F04D 29/542; F04D 29/545; F04D 19/002; F01P 2070/50; F01P 5/06
(Continued)

(56) References Cited

U.S. PATENT DOCUMENTS 4,219,325 A 8/1980 Gutzwiller
2008/0107524 A1* 5/2008 Chang ..... F04D 25/082 415/220

(Continued)

FOREIGN PATENT DOCUMENTS

CN 1813135 A 8/2006
EP 1369595 A2 12/2003

(Continued)

OTHER PUBLICATIONS

English machine translation of EP 1369595, Dec. 2003.*

(Continued)

*Primary Examiner* — Christopher Verdier
(74) *Attorney, Agent, or Firm* — David D. Brush; Westman, Champlin & Koehler, P.A.

(57) ABSTRACT

A generator system that includes an engine and an alternator which is driven by the engine to generate electrical power. A radiator is connected to the engine and an axial fan directs air toward the radiator to cool the radiator. A plurality of static vanes is located between the axial fan and the radiator. Each static vane includes an inner end and an outer end, the inner ends of the static vanes being joined together. The static vanes are curved in a plane orthogonal to the rotation axis in order to direct the air towards the axis, thereby counterbalancing the centrifugal forces. The static vanes may be twisted, the pitch angle increasing from 0 degree at hub to circa 45 degrees at tip. Additionally, each static vane is attached to the shroud via a third member that extends axially, thereby allowing an axial offset between shroud and static vanes.

10 Claims, 18 Drawing Sheets

(58) Field of Classification Search
USPC ..... 415/175–178, 211.2, 220, 223, 208.2, 415/209.2–209.4, 210.1
See application file for complete search history.

(56) References Cited

U.S. PATENT DOCUMENTS

| | | | | |
|---|---|---|---|---|
| 2009/0246017 | A1* | 10/2009 | Lee | F04D 25/0613 415/220 |
| 2012/0321474 | A1* | 12/2012 | Stevens | F01P 5/06 416/190 |

FOREIGN PATENT DOCUMENTS

| | | | | |
|---|---|---|---|---|
| FR | 1051810 | A | 1/1954 | |
| FR | 2784423 | A1 | 4/2000 | |
| GB | 792369 | | 3/1958 | |
| TW | CN-101666320 | A * | 3/2010 | F04D 19/00 |
| WO | 2005/003569 | A1 | 1/2005 | |
| WO | 2008031192 | A1 | 3/2008 | |
| WO | 2009066248 | A1 | 5/2009 | |
| WO | 2010022591 | A1 | 3/2010 | |

OTHER PUBLICATIONS

English machine translation of CN 101666320, Mar. 2010.*
English machine translation of FR 1,051,810, Jan. 1954.*
English machine translation of FR 2,784,423, Apr. 2000.*
International Search Report dated Jul. 16, 2013 for corresponding International Application No. PCT/EP2013/058698, filed Apr. 26, 2013.
Written Opinion of the International Searching Authority dated Oct. 26, 2014 for corresponding International Application No. PCT/EP2013/058698, filed Apr. 26, 2013.

* cited by examiner

| | | | | | | | | | |
|---|---|---|---|---|---|---|---|---|---|
| 10.3 | 9.7 | 10.3 | 12.2 | 9.6 | 9.2 | 8.1 | 7.2 | 7.9 | 8.4 |
| 8.4 | 8.5 | 10.2 | 10.5 | 7.6 | 9.3 | 8.3 | 7.2 | 6.8 | 7.9 |
| 7.6 | 10.4 | 9.5 | 10.5 | 3.7 | 5.6 | 6.3 | 6.3 | 6.5 | 7.1 |
| 7.5 | 11.3 | 9.3 | 4.9 | -2 | -2 | 4.8 | 7.4 | 7.6 | 6.4 |
| 7.4 | 9.8 | 9.2 | 6.7 | -1.8 | -1.5 | 4.1 | 7.6 | 7.9 | 5.2 |
| 8 | 9.7 | 10.3 | 8.5 | 1.6 | 4.5 | 6.1 | 8.1 | 6.3 | 5 |
| 8.7 | 8.8 | 9.2 | 9.2 | 7.9 | 6.6 | 7.7 | 8.5 | 6.3 | 4.2 |
| 8 .9 | 6.6 | 6.4 | 8.6 | 8.3 | 8.3 | 8 | 7.6 | 5.5 | 5.1 |
| 9 | 6.4 | 5.8 | 6.5 | 5.9 | 6.9 | 7.1 | 7.3 | 7 | 7.2 |
| 9.2 | 7.2 | 5.6 | 5.7 | 5.1 | 7.6 | 8.1 | 8.3 | 8.9 | 9.3 |

*FIG. 3*

| | | | | | | | | | |
|---|---|---|---|---|---|---|---|---|---|
| 7.7 | 7.4 | 10.3 | 11.2 | 6.1 | 5.9 | 6.6 | 5.7 | 3.6 | 5.3 |
| 6.6 | 6.8 | 8 | 9.7 | 6.4 | 7.3 | 8.9 | 8.6 | 5.9 | 6.4 |
| 7.9 | 8.5 | 9.6 | 7.7 | 3.7 | 5.1 | 6.2 | 7.7 | 5.7 | 7.9 |
| 7.8 | 8.5 | 7.4 | 4.8 | 3.5 | 4.3 | 4.4 | 4.6 | 6.1 | 7.9 |
| 6.6 | 6.9 | 7.2 | 3.7 | 3.3 | 5.3 | 3.4 | 4.8 | 7.3 | 5.8 |
| 7.1 | 9 | 8.8 | 5.8 | 2.8 | 3.2 | 3.2 | 4.6 | 3.3 | 3.3 |
| 7.3 | 7.9 | 8.9 | 8.5 | 4.2 | 5.1 | 4.6 | 4.6 | 4.1 | 4.4 |
| 8 | 7.1 | 7.6 | 8 | 6.2 | 6.5 | 7.8 | 6.6 | 4.9 | 5 |
| 7.6 | 7.5 | 6.7 | 6.6 | 5.9 | 6.9 | 4.8 | 3.9 | 3.6 | 4.8 |
| 5.7 | 6 | 5.5 | 5.7 | 5.4 | 7.1 | 7.2 | 6.9 | 6.1 | 6.8 |

*FIG. 9*

| R330C3 | | Target | W/O Static Vanes | With Static Vanes | Delta | |
|---|---|---|---|---|---|---|
| ATB | PRP | 42 | 47.9 | 57 | 9.1 | °C |
| | ESP | 42 | 44.2 | 53.7 | 9.5 | °C |
| CAC out (25°C ambiant) | PRP | 45 | 46 | 41.5 | -4.5 | °C |
| | ESP | 45 | 48 | 43.1 | -4.9 | °C |
| LwA 3/4 load | 100% fan speed | 97 | 100.4 | 97.9 | -2.5 | dBA |
| | 70% fan speed | 97 | 95.5 | 94.5 | -1 | dBA |

*FIG. 10*

AXIAL FLOW COOLING FAN WITH CENTRIPETALLY GUIDING STATOR VANES

CLAIM OF PRIORITY

This application is a Section 371 National Stage Application of International Application No. PCT/EP2013/058698, filed Apr. 26, 2013, which is incorporated by reference in its entirety and published as WO 2013/160432 A1 on Oct. 31, 2013, in English, which claims the benefit of priority of French Patent Application Serial No. 1253889, entitled "DISPOSITIF DE REFROIDISSEMENT COMPRENANT UN VENTILATEUR AXIAL A REDRESSEMENT DE FLUX CENTRIPETE ET GROUPE ELECTROGENE CORRESPONDENT," filed on Apr. 26, 2012, and which is incorporated by reference herein in its entirety.

TECHNICAL FIELD

This disclosure relates to fan-based cooling systems that include static vanes. The fan-based cooling systems may be used in the field of cooling heat engines, for example when they are integrated into a generating set.

BACKGROUND

Cooling systems with one or more fans are typically used to cool engines and a power generation system (sometimes referred to as a "generator" or "generating set"). For example, a fan may cool a radiator of an engine. The engine may, for example, be part of the power generation system. A cooling system that uniformly cools components of the engine or power generation system, such as the radiator, may be useful in efficiently cooling and operating the power generation system.

BRIEF DESCRIPTION OF THE DRAWINGS

The innovation may be better understood with reference to the following drawings and description. In the Figures, like reference numerals designate corresponding parts throughout the different views.

FIG. 3 shows a table of example air flow velocity measurements at a radiator outlet located downstream of the axial fan in FIG. 1.

FIG. 9 shows a table of example velocity measurements of air flow at the radiator outlet for the static vane configuration shown in FIG. 8.

FIG. 10 shows a comparison table of example temperature readings that were taken of a radiator with and without static vanes.

DETAILED DESCRIPTION

Engines and power generation systems may include cooling systems that operate to cool one or more components of the engine or power generator system, such as a radiator, an alternator, or engine components. Cooling systems may include a one or more axial or helical fans (referred to as "axial fans" or "fans") that may drive a cooling fluid towards the power generation component to be cooled. While the follow description may reference a cooling system for a power generation system, it should be understood that these cooling systems may also be used with engines in other applications.

Figure 1:
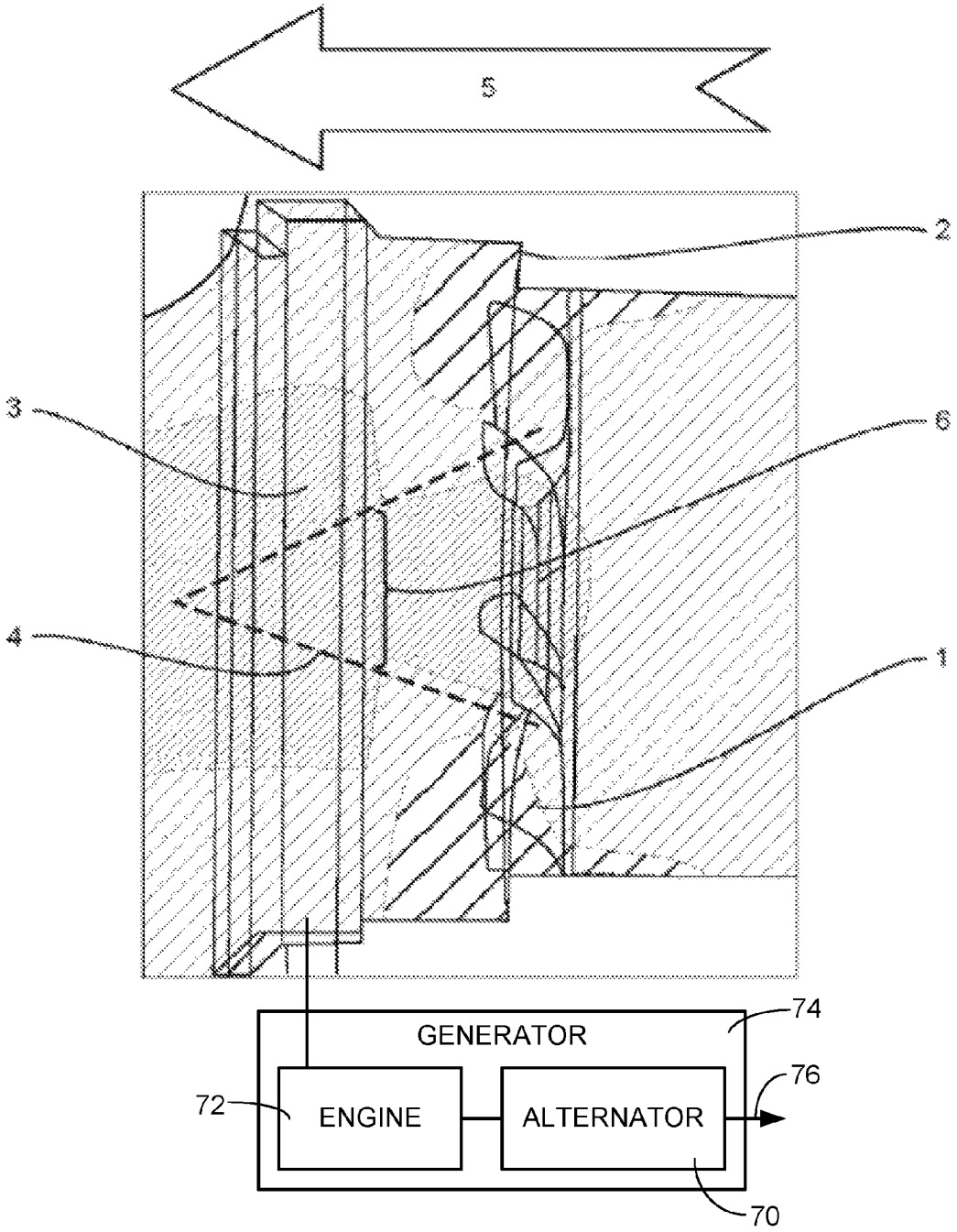
FIG. 1 shows an example cooling system with an axial fan, and distribution of fluid speeds by the cooling system.
Figure 2:
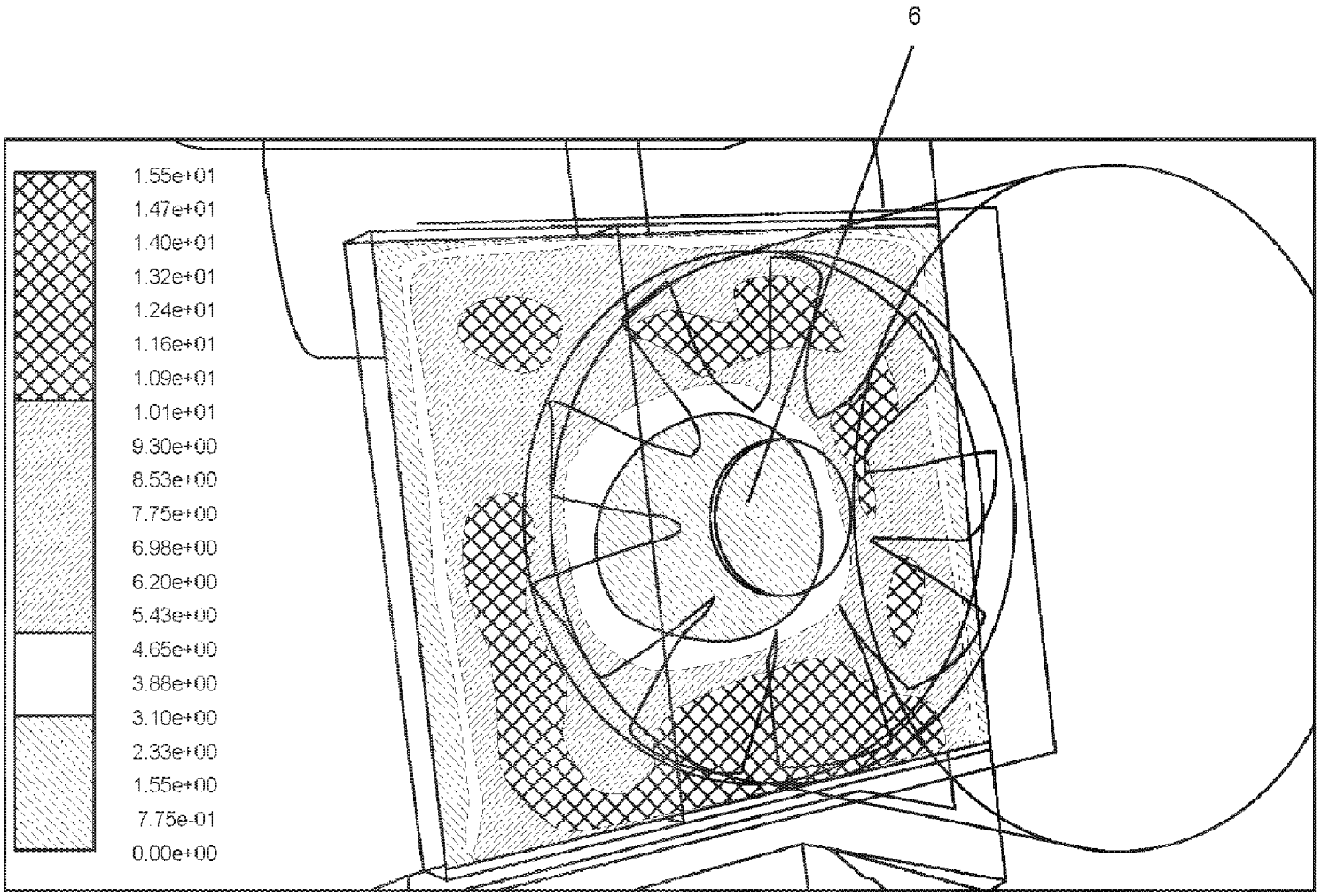
FIG. 2 shows an example central zone of a radiator arranged downstream of the axial fan in FIG. 1.

FIG. 1 shows an example cooling system 100 with an axial fan 1, and distribution of air flow speeds within the cooling system 100. FIG. 2 shows an example central zone of a radiator arranged downstream of the axial fan in FIG. 1.

The axial fan 1 may drive cooling air according to, parallel with, or otherwise along an axis that the axial fan rotates (such as axis 23 in FIGS. 4 and 5), or in other directions.

Figure 4:
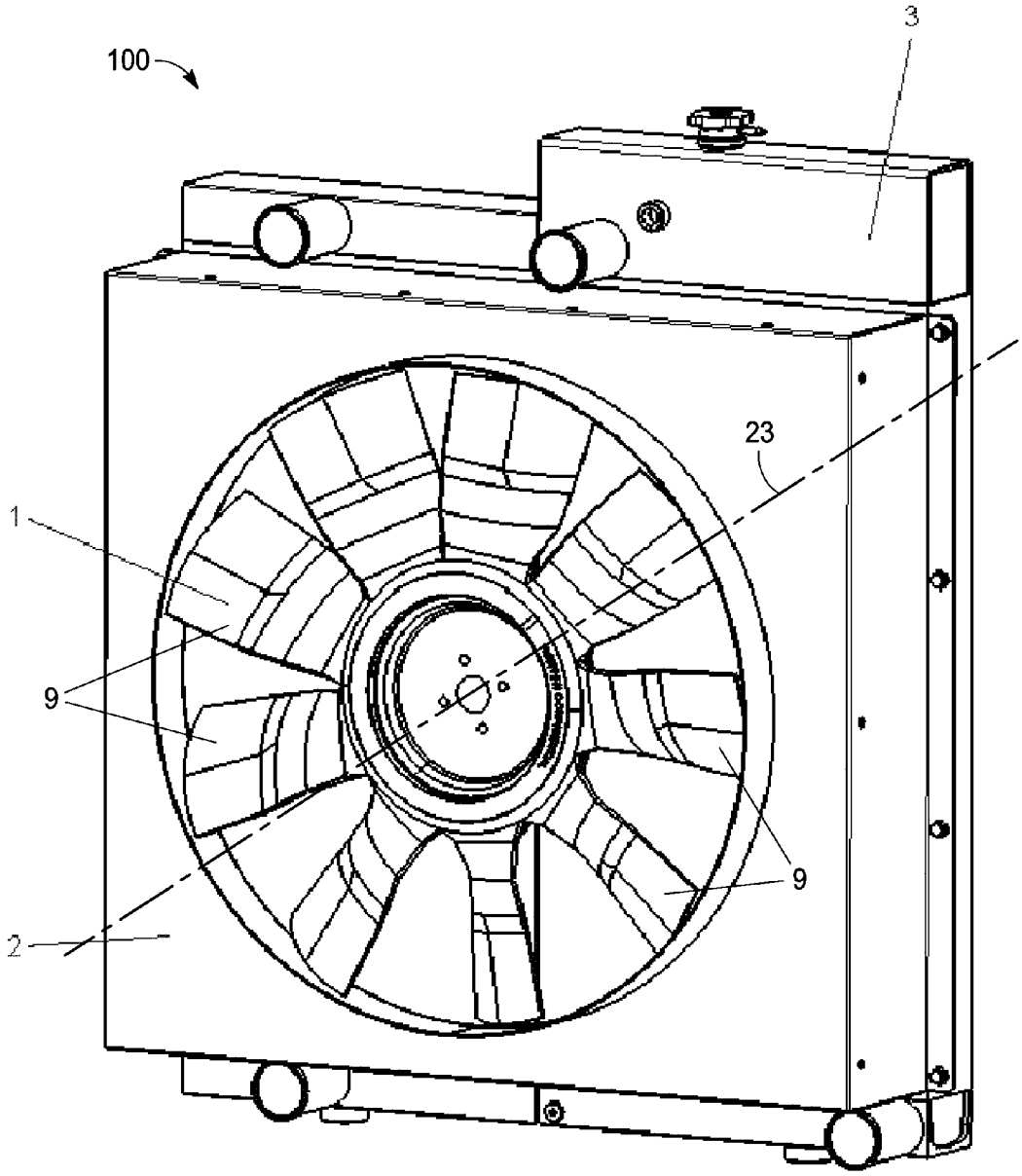
FIG. 4 shows an example of certain elements of a cooling system for a generating set.
Figure 5:
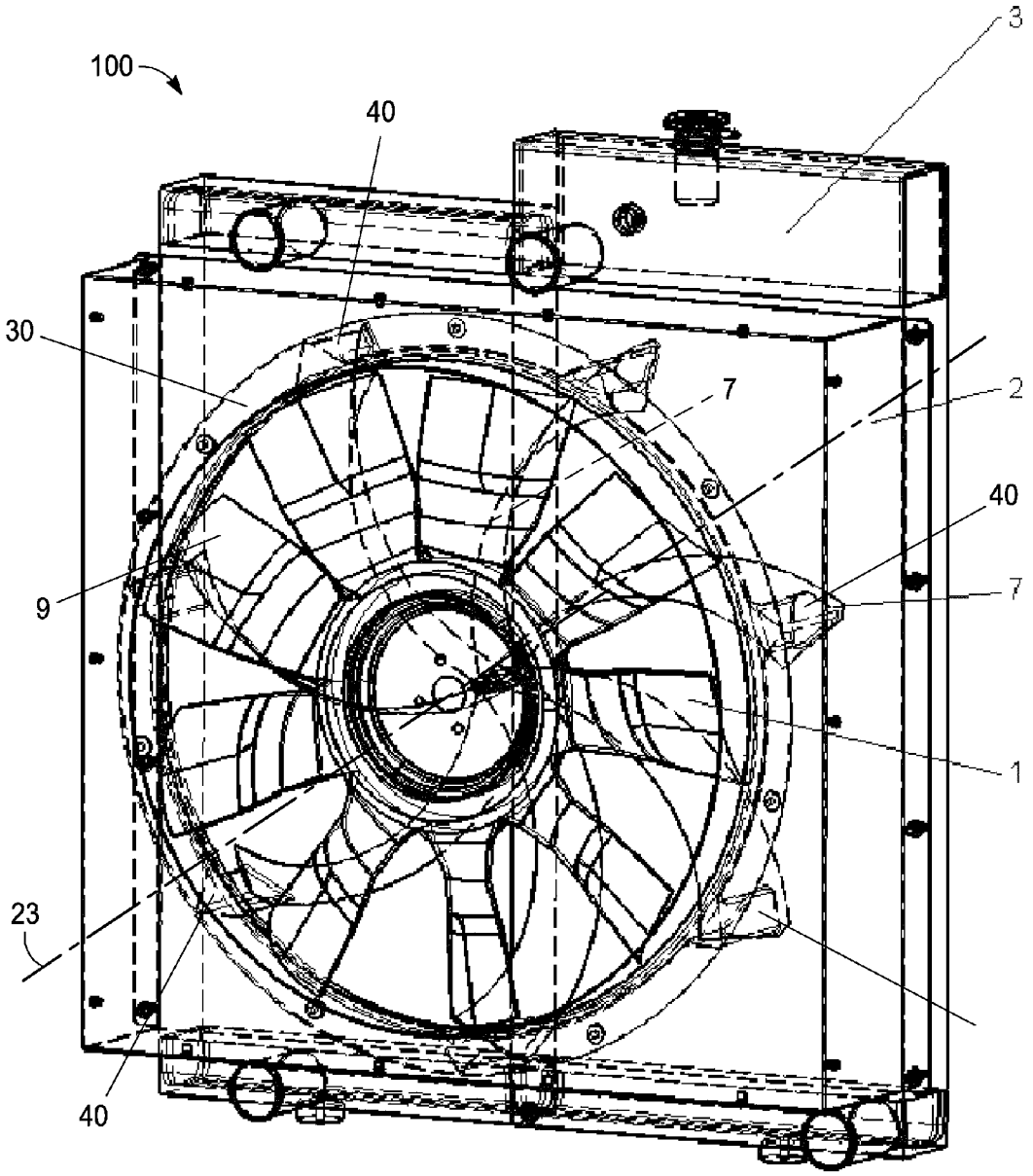
FIG. 5 shows an example of a cooling system with static vanes.

The axial fan 1 may operate by setting into rotation a propeller, which may include mobile blades 9 (see FIGS. 4 and 5). The rotation of the propeller and mobile blades 9 may make it possible to axially drive cooling air towards equipment, such as a radiator 3, that one wishes to cool. The axial fan 1 may operate with or drive any type of cooling fluid, including compressible fluid, gases, or ambient air. The axial fans may make it possible to blow cool air towards the equipment to be cooled.

The air flow of the axial fan 1 may be carried out in a ventilation nozzle 2. The axial fan 1 may be positioned in, adjacent to, or in communication with the ventilation nozzle 2. The ventilation nozzle 2 may guide, direct, or otherwise allow for the flow of cool air towards the equipment to be cooled. For simplicity, the equipment cooled by the cooling system 100 and axial fan 1 may be, and may be referred to as, a radiator 3. However, the cooling system 100 may also or alternatively be used to cool various other components, such as an alternator 70, engine component 72, or other component of a power generation system 74, as illustrated schematically in FIG. 1.

When operating, the mobile blades 9 of the fan 1 may enter into rotation and suck or pull cooling fluid (such as air) in. The air may then be transmitted or directed by the fan 1, via a ventilation nozzle 2, to equipment that one desires to cool, such as the radiator 3. A cooling system 100 with only an axial fan may not be an ideal system for cooling of a radiator 3. In some systems with only an axial fan, when the fan 1 is operating, its mobile blades 9 may enter into rotation and tend to act on the mass of the cooling fluid to drive the cooling fluid in rotation. This rotation of the cooling fluid may reduce the relative speed of the mobile blades 9 in relation to the fluid, which may result in a decrease in the output and efficiency of the axial fan 1.

Furthermore, there may be a centrifugal effect linked to the rotation of the mobile blades 9 of the fan 1 that may increase air flow, speed, and pressure on an outside edge of the axial fan 1. Conversely, a low pressure zone may be generated near a center of the axial fan 1. During operation of a power generation system cooled with only an axial fan, there may be an increase in temperature at a central area of the radiator 3, which may be due in part to the recirculation of the air through the radiator 3. Air may recirculate through the radiator 3 partly because axial fans may produce not only an axial effect, but also a centrifugal effect on the cooling air due to the speed of rotation. This centrifugal effect may cause an increase in pressure on an external area of the axial blades.

Inversely, a low pressure zone may be generated at an inside edge, or center, of the fan 1 or the fan's delivery zone. As such, during the rotation of the mobile blades 9, an inactive cone 4 may be formed downstream of the fan 1 in the direction 5 of air displacement. This inactive cone 4 may be a "dead" zone, where the pressure and the ventilation flow of the cooling fluid are low, or even zero.

The inactive cone 4 shown in FIG. 1 was generated using a CFD (Computer Fluid Dynamic) calculation, and shows the distribution cooling air flow velocity generated by the axial fan 1.

The base of the inactive cone 4 may be located at the base of the mobile blades 9 of the fan 1. The top of the inactive cone 4 may be more or less separated from the fan. The size of the inactive zone 4 will depend in part on the characteristics and the dimensions of the axial fan 1. In this inactive cone 4, the air flow velocity may be very slow, or practically zero.

In certain cases, the airflow in the inactive cone 4 can even be negative. The back pressure that is generated by the plenum after the radiator 3 may be sufficient to generate unwanted air flow back toward the low-pressure zone. For example, if the pressure downstream of the cooling radiator 3 is greater than that of this dead zone, a recycling phenomenon may occur. In these cases, hot air located downstream of the radiator 3 may pass back into the dead zone of the inactive cone 4, which can result in a loss of effectiveness of the radiator 3 within the cooling system 100. This hot air may be continually mixing with cooling air resulting in decreased cooling system efficiency.

FIG. 3 shows a table of example measurements of air flow speeds at a radiator outlet for a cooling system with only an axial fan. The measurement of the air flow was made by a technician using a hand anemometer standing in the air outlet plenum with the front panel open such that there is no back pressure due to the plenum.

The table in FIG. 3 illustrates a lack of cooling air flow in the central area 6 of the radiator 3. The velocity of the cooling air may even be negative in this central area 6.

As a result of the inactive cone 4, the radiator 3 which is cooled by only the axial fan 1 may receive air flow that is generated by the axial fan 1 over its entire surface, except for the central zone 6 located in the inactive cone 4. In these cooling systems, the entire surface of the radiator 3 is not uniformly cooled thereby resulting in inefficient heat exchange. This inefficiency may result in the need for an overly large cooling system 100, and/or a required drop in the output of the power generation system in order to reduce temperature.

In order to account for this issue, in some systems, the radiator 3 (or the equipment that is sought to be cooled) may be separated from the fan 1 by a greater distance, such that the inactive cone 4 does not overlap any portion of the radiator 3. By placing the radiator 3 sufficiently away from the fan, the radiator 3 can be extracted from the influence of the inactive cone 4.

However, such a solution may harm the compactness of the system and may result in an unacceptable increase in the dimensions of the unit. This may be the case in some generator sets, where the heat engine may be cooled by way of one or more cooling radiators associated with one or more axial fans, and which must respond to severe size constraints.

One system may include an air conduit for an electric fan, with moving blades and interconnecting elements extending between an outer ring and an inner ring member coaxial with the movable vanes. Such interconnection elements may deflect the air flow towards the axial direction. Thus, the airflow may be placed in an expected direction to pass through the radiator, which may promote the penetration of air into the radiator core. The effect may be similar to an effect from the use of fixed blades or counter-rotation in the turbine, or turbo-prop engines. However, such systems may not compensate for a dead zone created near the center of the axial fan.

Figure 6:
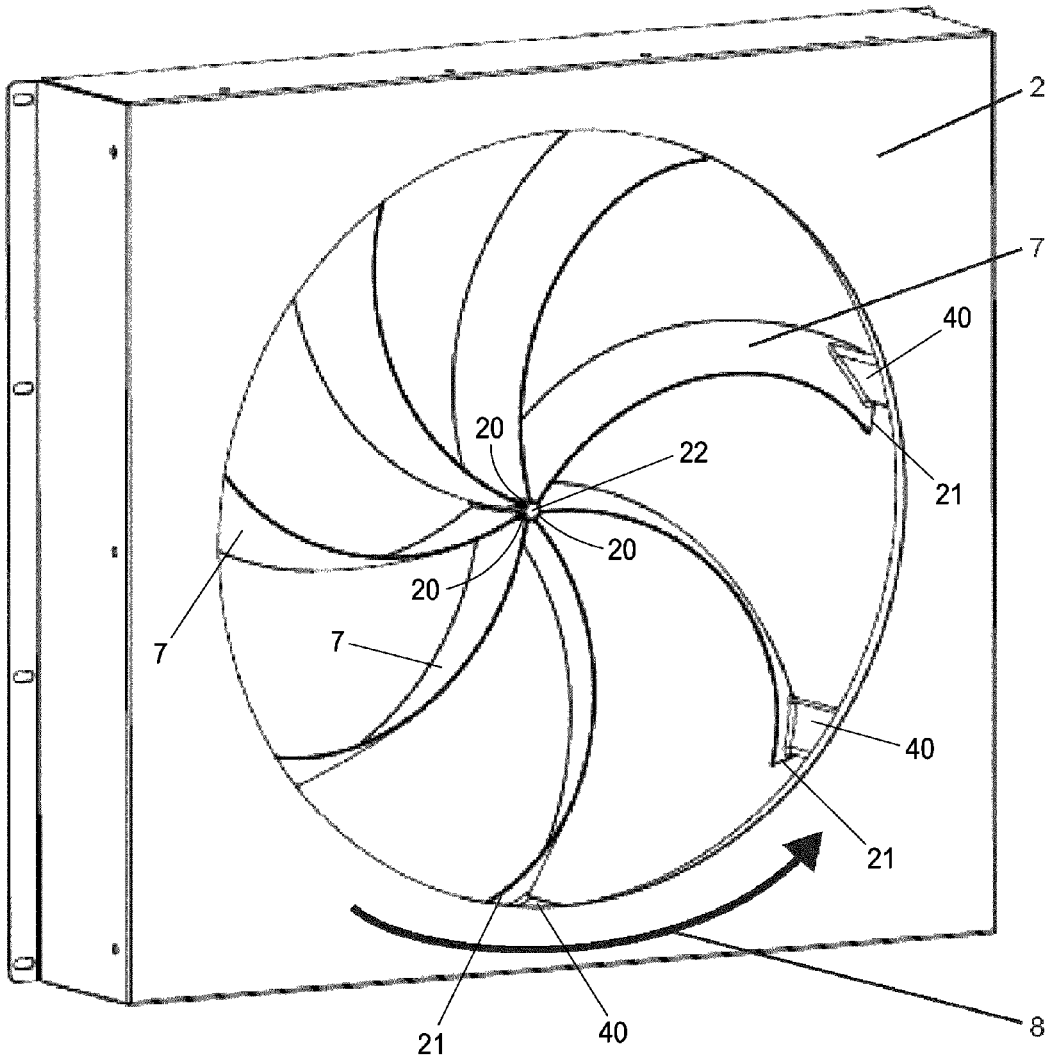
FIG. 6 shows an example of a cooling system with static vanes.
Figure 7C:
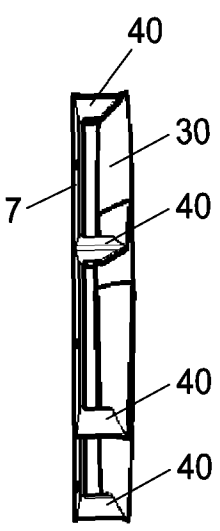
FIG. 7C shows an example right view of static vanes of a cooling system.
Figure 7B:
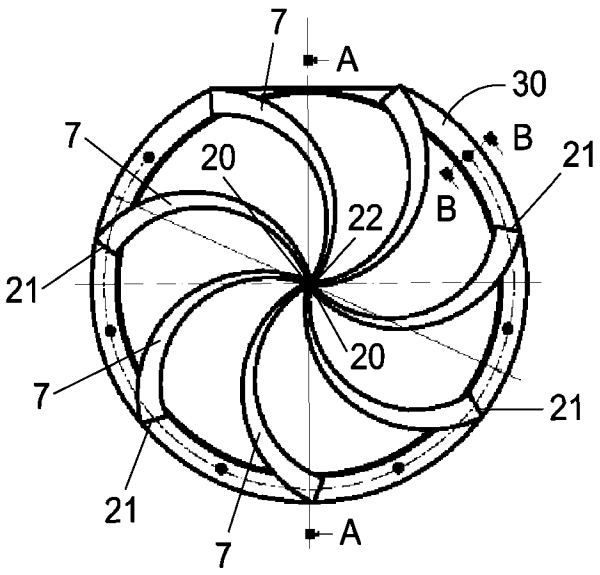
FIG. 7B shows an example rear view of static vanes of a cooling system.
Figure 7A:
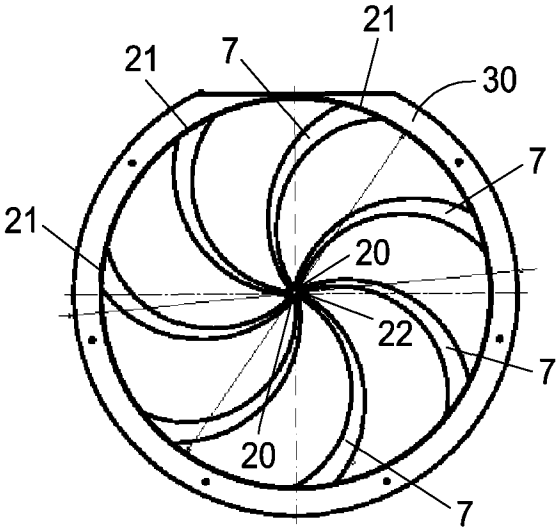
FIG. 7A shows an example front view of static vanes of a cooling system.
Figure 7F:
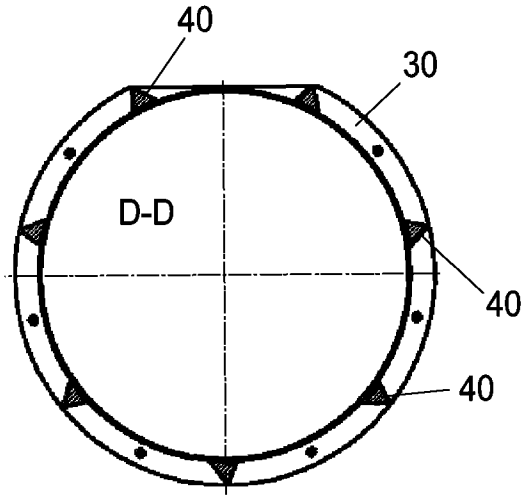
FIG. 7F shows an example cross-section D-D view of the static vanes shown in FIG. 7D.
Figure 7E:
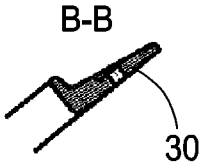
FIG. 7E shows an example cross-section B-B view of a ring around the static vanes shown in FIG. 7B.
Figure 7D:
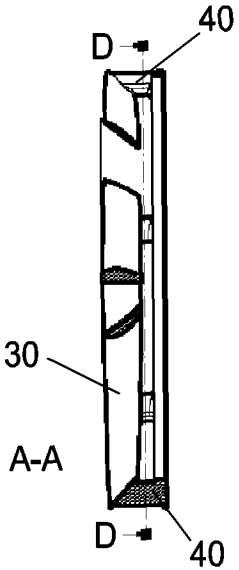
FIG. 7D shows an example cross-section A-A view of the static vanes shown in FIG. 7B.
Figure 7G:
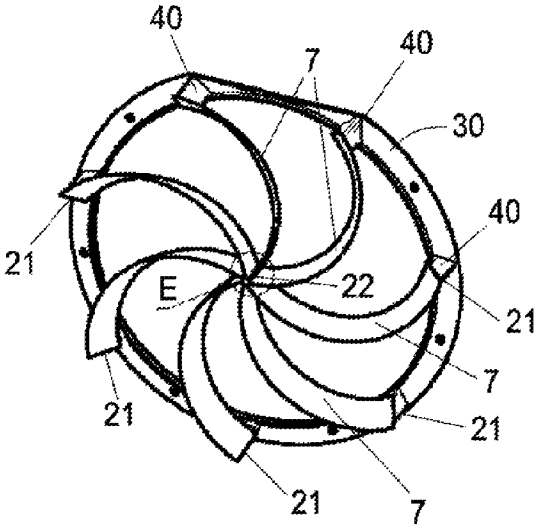
FIG. 7G shows an example perspective view of static vanes of a cooling system.
Figure 7H:
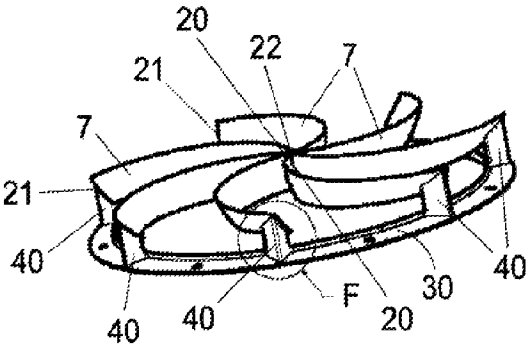
FIG. 7H shows an example perspective view of static vanes of a cooling system.
Figure 7I:
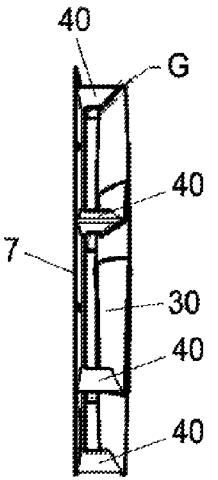
FIGS. 7J, 7K and 7L respectively show enlarged views of a static vanes within circle E of FIG. JG, the static vanes within circle F of FIG. 7H, and the static vanes within circle G of FIG. 7L.
Figure 7K:
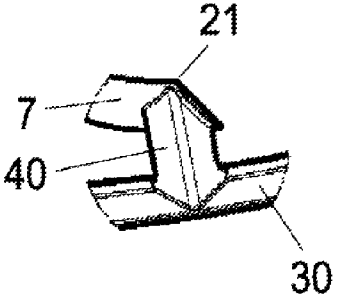
Figure 7L:
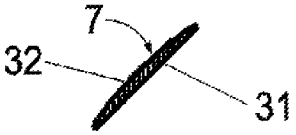
Figure 7J:
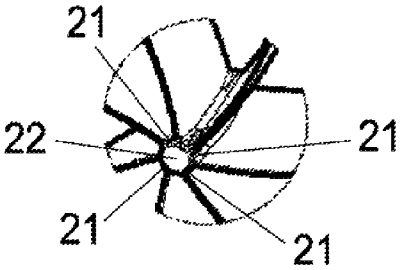

FIG. 4 shows an example of a cooling system 100 for a power generation system, showing the axial fan 1 and hiding the static vanes 7. FIG. 5 shows the cooling system with both the axial fan 1 and the static vanes 7 (also referred to as "stator vanes", "static blades", "stator blades", or "fins") shown. FIG. 6 shows the cooling system with the static vanes 7 shown and the axial fan 1 hidden. The cooling system in FIGS. 4-6 may operate to reduce or eliminate the inactive cone 4 generated with just an axial fan 1.

The power generation system (or generating set) may be an autonomous device that makes it possible to produce electrical energy using a heat engine. In addition to the cooling system, the power generation set may include a heat engine and an alternator connected to the heat engine. The alternator may be configured to transform mechanical energy received from the heat engine into electrical energy. The power generation system may be used for, or make it possible, either to overcome a cut-off of the public power grid, or to power electrical devices in zones that do not have access to the public power grid.

The generating set may include a frame that the heat engine may be mounted on. The alternator may be mounted on the frame and connected to the heat engine in order to be able to transform the energy received from the heat engine into electrical energy. A control and connection box may be connected to the alternator and there may be at least one air inlet in the frame to supply the heat engine.

During operation, the heat engine may rise in temperature, and it may be important to provide, in the generating set, a suitable cooling system, in order to maintain its temperature in an acceptable range in order to retain proper operation. Such a cooling system may also make it possible to prevent the deterioration of the engine and other components of the generating set, which could be caused by the rise in the temperature linked to the heat generated by the components of the power generation system.

The cooling system 100 may include a radiator 3, through which circulates a fluid to be cooled (cooling water of the engine block, charge air, oil, fuel, etc.). In some other systems, the cooling system 100 may exist separately from, or independently from, a radiator 3.

The cooling system 100 may also include an axial fan 1 that may blow air through the radiator 3. The air flow from this axial fan 1 may be created in a ventilation nozzle 2, which may serve as a manifold for the radiator 3.

In order to maintain the operating temperature of the generating set within an acceptable range as well as maintain good air flow output, it may be helpful if the axial fan 1 operates as effectively as possible. The axial fan 1 may rotate and drive a cooling fluid (such as cool air) through the ventilation nozzle 2 to the radiator 3.

The cooling system 100 may include a set of static vanes 7 that may cause more efficient distribution of the air flow generated by the axial fan 1. The static vanes 7 may be positioned facing the moving axial fan 1. The static vanes 7 may be located in the ventilation nozzle 2, and may form a contra-rotating system preventing the air flow rotation by the mobile blades 9 of the fan 1. By blocking the air flow rotation, the relative speed of the blades of the fan 1 may be improved relative to the air thereby recovering some of the efficiency of the axial fan.

The cooling system 100 may also reduce the harmful influence of the inactive cone 4 located downstream of an axial fan 1 without significantly increasing the overall size of the cooling system 100. The cooling system 100 may also be reliable and inexpensive to implement. The cooling system 100 may also decrease the sound level of the cooling system.

The cooling system may include at least one axial fan 1 comprising one, two, or more mobile blades 9 in rotation. The axial fan 1 and mobile blades 9 may be able to generate air flow through a ventilation nozzle 2, towards an element to be cooled, such as the radiator 3.

The cooling system 100 may also include one, two, or more static vanes 7 arranged adjacent, opposite, or otherwise near the mobile blades 9. The static vanes 7 may, for example, be positioned near, with, or in the ventilation nozzle 2, or in various other locations. For example, the static vanes 7 may be mounted to the ventilation nozzle 2, either directly, or through another component such as an outer ring 30. The static vanes 7 may be connected at their distal end with the outer ring 30, which may be a substantially annular member having a diameter greater than the diameter of said axial fan. The annular outer ring 30 may have a tapered or flared shape at a portion extending upstream of the axial fan 1, so as to create a Venturi effect on the cooling air entering the fan 1. This shape may contribute to the efficiency of the fan. Other variations are possible.

The static vanes 7 may make it possible to counter the air flow rotation caused by the driving effect of the mobile blades 9 of the fan 1. The presence of the static vanes 7 downstream of the fan 1 in relation to the direction 5 of displacement of the cooling fluid, such as in the ventilation nozzle 2, may make it possible to increase the output of the fan 1 and more uniformly cool the radiator 3.

The static vanes 7 may be in opposition to the blades 9 of the axial fan 1. The static vanes 7 may be adjustable in order to modify an angle of inclination of all or a portion of the static vanes 7 in relation to the air flow direction.

In many systems, the static vanes 7 may be fixed in rotation, as opposed to the fan blades 9. In other systems, the static vanes 7 may be adjustable or pivotable, for example to change an inclination angle of all or part of the blades relative to the direction of movement of the fluid.

The static vanes 7 may take various forms and be able to adjust the air flow generated by the fan 1 from a simple air flow to a more complex air flow.

The static vanes 7 may be curved or of curved shape. The static vanes 7 may have a curvature included in a plane substantially perpendicular to an axis of rotation of the mobile blades 9. The plane perpendicular to the axis of rotation of the mobile blades 9 may be referred to as the plane of rotation.

The static vanes 7 may generate a centripetal effect on the air flow generated by the mobile blades 9 of the fan 1. The axial fan 1 may rotate in a direction 8 about an axis of rotation, thereby directing the cooling fluid in a rotational direction toward a radiator 3. The curvature of the static vanes 7 may operate to direct, orient, or otherwise tend to return a portion of the cooling fluid towards a central area 6 located downstream of the fan 1, in a direction towards the axis 23 of rotation of the mobile blades 9. By directing a portion of the air flow toward the axis 23 of rotation of the mobile blades 9, the static vanes 7 may reduce, or prevent the creation of the previously described inactive cone 4.

The static vanes 7 may be of a simple shape, and therefore inexpensive. They may make it possible to orientate a portion of the air flow towards the central area downstream of the fan 1.

Additionally or alternatively, the static vanes 7 may have uniform, or differing, pitch angles along the length of the static vane 7. A pitch angle may be an angle formed by the chord of the blade of the propeller and the axis of rotation of the propeller. Inclining the outer ends of the static vanes 7 may make it possible to optimise the distribution of the air pressure generated by the fan 1 on either side of the static vanes. Inclining the outer ends of the static vanes 7 may also prevent the formation of low pressure zones behind the static vanes 7. It may also make it possible to reduce the noise generated by moving the mobile blades 9 of the fan 1 by the static vanes 7.

The static vane 7 may have a non-zero pitch angle with respect to the axis of rotation at some point along a length of the static vane 7. For example, the static vanes 7 may have a non-zero pitch angle with said axis of rotation at their distal, or outer, end. In some examples, the static vane 7 may have a pitch angle near, or substantially equal to 45°. An inclined angle may make it possible to optimise the distribution of the pressures upstream and downstream of the static vanes thereby preventing a cavitation effect. Other values of the pitch angle can also be adopted, and may depend on the shape of the static vanes 7 and the operating constraints imposed on the cooling system 100. In some cooling systems 100, an optimal value for this pitch angle may be determined for example via a CFD calculation or by fine tuning during performance tests.

A portion or the entire static vane 7 may additionally or alternatively be twisted. For example, the static vane 7 may have a pitch angle which may change, suddenly or gradually, at a point or over a portion or entire length of the static vane. In some cooling systems 100, the static vane 7 may rotate, over an entire length, in such a way as to improve fluid pressure. This improve fluid pressure may improve the air flow on the surface of the radiator 3. In some systems, the static vanes 7 may rotate less than a full half-turn. Such a twisting may be progressive and increase from the center of the static vanes 7 towards their outer end. As an example, a static vane 7 may have a zero pitch angle at an inner end, a 45 degree pitch angle at an outer end, and a gradually changing pitch angle moving from zero to 45 degrees along the length of the static vane 7 from the inner end to the outer end.

The cooling system 100 may include any number of static vanes 7. In some power generation systems, cooling system 100 may include a number N of static vanes 7, such as seven static vanes. The number N of static vanes 7 may differ from the number P of mobile blades 9 of the fan 1. Having a different number N of static vanes 7 as compared to the number P of mobile blades 9 may prevent the generation of noise by the superposition of acoustic pressure waves generated at the passage of each blade mobile 9 in front of a static vane 7. In some systems, the number N and the number P may be coprime numbers.

In some cooling systems 100, the number N of static vanes 7 and the number P of mobile blades 9 of the fan 1 in the cooling system 100 are two prime numbers. These differing static vane 7 and blade 9 numbers may reduce a resonance phenomenon that generates noise. For example, in the case of a fan 1 with nine mobile blades 9, seven static vanes 7 may be arranged in the ventilation nozzle 2. Other combinations of numbers of static vanes 7 and mobile blades 9 are of course possible. In other systems, the number N and the number P may be the same.

In some power generation systems, the static vanes 7 of the cooling system 100 may be identical and equally-distant from each other. Systems with static vanes 7 that are identical and equally-distant may make it possible to obtain a homogenous adjustment of the air flow over the entire area of the fan 1. In other systems, the static vanes 7 may not be identical or equally distant from each other.

In some power generation systems, the element to be cooled may be a radiator 3 of a heat engine cooling system. Some heat engine cooling systems may be provided with one or more cooling radiators which may use ambient air to cool the various fluids which circulate in the radiators (cooling water of the engine block, charge air, oil, fuel, etc.). The cooling of the radiator 3 may be carried out via air flow generated by one or more axial fans blowing cooling air through the radiator 3. In these types of cooling systems 100, the space and/or size constraint of the cooling system 100 may be important.

The cooling system 100 may resolve uniform cooling issues without requiring larger space or size. The shape of the static vanes 7, formed and/or mounted in the ventilation nozzle 2, may be chosen in such a way as to return the air flow displaced by the blades in rotation from the fan 1 towards the corresponding central area (i.e., the inactive cone 4). Therefore, the effect of this inactive cone may be alleviated or cancelled without requiring additional spacing from the radiator 3. More precisely, in some forms of the cooling system 100, the static vanes 7 may have a curved shape that adjusts the air flow generated by the axial fan 1 in order to return a portion of the air flow to the central area 6 via centripetal effect.

The presence of the static vanes 7 across from the mobile blades 9 of the fan 1 may make it possible to counter the air flow rotation generated by the mobile blades 9 of the fan 1. The curved shape of the static vanes 7 may make it possible to return the air flow via the centripetal effect towards the axis of rotation of the fan 1 and avoid creating the inactive cone 4 downstream of the fan 1. The curved shape of the static vanes 7 may also make it possible to maintain pressure in the central area 6 such that the fan 1 is able to adequately supply the central area 6 with cool air and prevent any hot air from returning through the center of the radiator 3. Finally, the inclination of approximately 45° at the outer end of the static vanes 7 may make it possible to more efficiently distribute the air flow directed toward the radiator 3, and by preventing the creation of a vacuum zone which can form downstream of the static vanes 7 when there is no inclination. An inclination at the outer end of the static vanes 7 may also make it possible to reduce the noise that is generated by passing a mobile blade 9 of the fan 1 in front of the static vane 7.

The value of the pitch angle of the distal end of the static vane 7 in relation to the axis or plane of rotation may be adapted on a case-by-case basis, for example via a CFD calculation. The value of the pitch angle may be determined in order to reduce as much as possible the appearance of vacuum zones and/or the noise generated. Such an adaptation may also take into account the shape of the static vane.

The static vanes 7 may be made from any suitable material for the type of cooling fluid under consideration. In the case of ambient air, the static vanes 7 may be made of metal or potentially plastic in order to reduce cost. Some or all of the static vanes 7 may be made of plastic that may be attached to the ventilation nozzle 2. The cost of production may be further reduced by creating from a single block the unit that includes the ventilation nozzle 2 and the static vanes 7. Other variations are possible.

FIGS. 7A to 7L show examples of possible dimensions and shapes of the static vanes 7. The generator system 74 may include an engine 72 and an alternator 74 driven by the engine to generate electrical power. 76, as shown in FIG. 1. A radiator 3 may be connected to the engine and an axial fan 1 may direct air or another fluid toward the radiator 3 to cool the radiator 3. One or more static vanes 7 may be located between the axial fan 1 and the radiator 3.

The static vanes 7 may include an inner end 20 and an outer end 21. The inner ends 20 of the static vanes 7 may be joined together.

For example, the inner ends 20 of each of the static vanes 7 may be joined together along an edge 22 (or an outer surface of a small tube). In other example forms, the static vanes 7 may be joined to together at a single point. For example, the static vanes 7 may be created from a single plastic molding with each of the static vanes 7 meeting at a center point. In some of these examples, the static vanes 7 may not have a hub or central joining member that substantially blocks or prohibits air flow along the axis of rotation of the axial fan 1. Other variations are possible.

The axial fan 1 may rotate about the axis 23. The static vanes 7 may be positioned next to, adjacent to, or opposite the axial fan 1. The static vanes 7 may extend a length from an inner end 20 of the static vane 7 to an outer end 21 of the static vane 7. The length may be straight, or may follow a curved or winding path in a direction perpendicular to the axis 23 and be generally parallel with the plane of rotation. For example, the static vanes 7 may be curved to direct the fluid from the axial fan 1 toward the axis 23. As an example, the static vanes 7 may be arc-shaped, or non-linear, from the inner end 20 to the outer end 21 of the each static vane 7.

Figure 8:
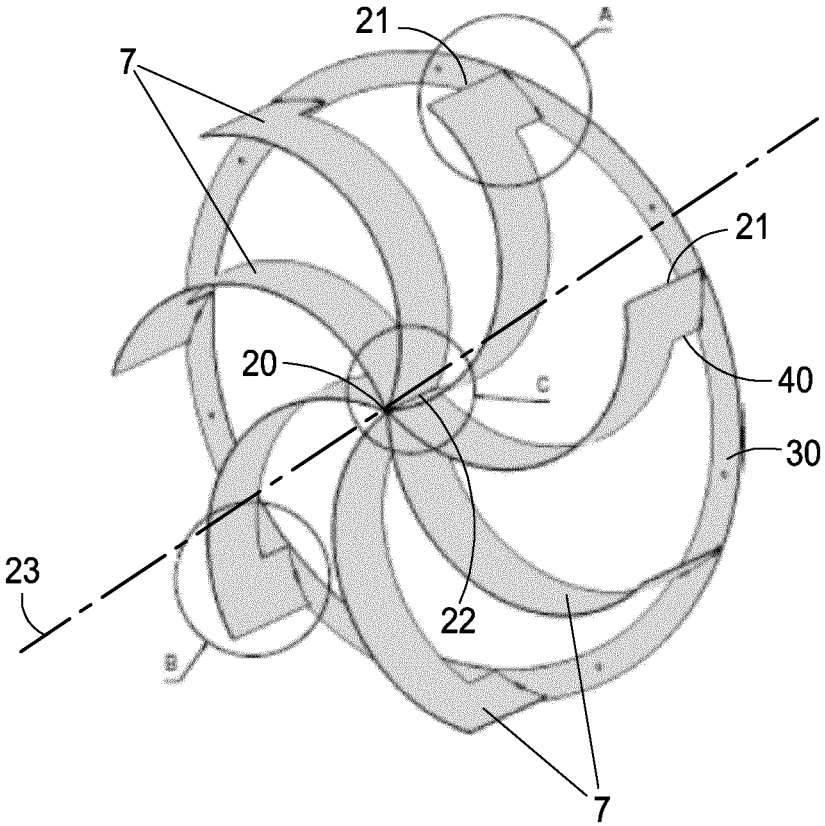
FIG. 8 shows example static vanes that have a zero pitch angle along the entire length of the static vanes.

In some forms, the static vanes 7 may include a surface along the length of the each static vane 7. As an example, the surface of the static vanes 7 may have a zero pitch angle with respect to the axis 23 along at least a portion of the length of the static vanes 7. FIG. 8 illustrates an example where the static vanes 7 have a zero pitch angle with respect to the axis 23 along the entire length of the static vanes 7.

FIG. 9 illustrates a table of velocity measurements of air flow at the radiator 3 outlet for the static vane 7 configuration shown in FIG. 8. The results illustrated in FIG. 9 indicate that having a cooling system using static vanes 8 as shown in FIG. 8 may create improved air velocity in the central area 6, and thus increased cooling capabilities for the radiator 3 and the system. The results illustrated in FIG. 9, as compared to the results illustrated in FIG. 3, indicate that the average airflow of the cooling system with static vanes is similar to the average airflow of the cooling system without static vanes, but the distribution in the cooling system with static vanes is significantly improved.

FIG. 10 shows a comparison table of temperature readings that were taken of a radiator 3 without static vanes and with the static vanes 7 shown in FIG. 8. The comparison table illustrates that utilizing the static vanes 7 shown in FIG. 8 may significantly reduce the temperature at the central area 6 of the radiator 3.

A prototype was used to create the table in FIG. 10.

In some forms, the static vanes 7 may be twisted. As an example, each of the static vanes 7 may have a zero pitch angle at the inner end 20 and a non-zero pitch angle at the outer end 21, with a varying pitch angle along the length of the static vane 7 from the inner end 20 to the outer end 21.

Utilizing twisted static vanes 7 may increase air flow and air distribution behind the static vanes 7. Therefore, the twisted static vanes 7 may improve efficiency of the cooling system 100. In addition, the twisted static vanes 7 may reduce the noise created by waves of pressure that may be created by the axial fan 1 blades moving in front of the static vanes 7.

The static vanes 7 may have a uniform width from an inner end 20 of the static vanes 7 to an outer end 21 of the static vanes 7. Other forms of the static vanes 7 are contemplated where width of the static vanes changes from the inner end 20 of the static vanes 7 to the outer end 21 of the static vanes 7.

The static vanes 7 may have different cross-sectional shapes. For example, the static vanes 7 may have a non-symmetrical cross-section. As an example, the static vanes 7 may have a lower surface 31 and an upper surface 32 of different shapes. In some forms, the static vanes 7 may have a profile similar to an airplane wing. In other examples, the static vanes 7 may have other cross-section shapes, such as rectangular, triangular, curved, rounded, or various other shapes.

One or more of the static vanes 7 may be connected with an outer ring 30 or the ventilation nozzle 2. For example, the outer ends 21 of each of the static vanes 7 may be joined to an outer ring 30. The overall size and shape of the outer ring 30 may depend in part on (i) the size of the axial fan 1; (ii) the shape of the ventilation nozzle 2; and (iii) the size and shape of the static vanes 7 (among other factors).

In some generator systems, the static vanes 7 may attach to the outer ring 30 or ventilation nozzle 2 through or using a leg, attachment, or other member 40. For example, the static vane 7 may include an outer end 21 that has a member 40. The member 40 of the static vane 7 may be attached to an outer ring 30 or the ventilation nozzle 2. The members 40 may be attached near, or directly to, an outer end 21 of the static vane 7, or to another portion of the static vane 7.

In some examples, the member 40 extends toward the engine. As an example, the member 40 may extend in a direction parallel to a longitudinal axis 23 of the axial fan 1. The members 40 may be integrally formed with (i) the outer ring 30 or ventilation nozzle 2; and/or (ii) the respective static vane 7 that the member 40 attaches to the outer ring 30 or ventilation nozzle 2. The overall size and shape of each member 40 may depend in part on (i) the size and shape of the outer ring 30; (ii) the shape of the ventilation nozzle 2; and (iii) the size and shape of the static vanes 7 (among other factors).

In some forms, the axial fan 1 may be at least partially inside of the outer ring 30. For example, the outer ring 30 may be positioned, partially or completely, along the rotation plane of the axial fan 1, such that the axial fan 1 rotates within the outer ring 30. In this example, the members 40 may be used to offset the static vanes 7 from the axial fan 1, such that the static vanes 7 lie just in front of, or behind, the rotating axial fan 1. The use of an outer ring 30 positioned along the rotational plane of the axial fan 1 may minimize the space required for the static vanes 7, while also maximizing the efficiency of the cooling system 100. In other examples, the outer ring 30 may be positioned in front of, behind, or otherwise offset from the axial fan and the plane of rotation. The degree to which the axial fan 1 is inside the outer ring 30 may depend in part on the overall design of the generator cooling system.

A center of the outer ring 30 may lie along the longitudinal axis 23 of the axial fan 1. In other example forms, the center of the outer ring 30 may be offset from the longitudinal axis 23 of the axial fan 1.

The static vanes 7 may have a zero pitch angle at the inner end 20 of the static vanes 7 and a non-zero pitch angle at the outer end 21 of the static vanes 7 where the static vanes 7 are formed with each respective member 40. The degree of pitch angle at the outer end 21 of the static vanes 7 may determine in part the overall size and shape of the member 40.

The outer ring 30 may be a ring having uniform width and thickness. Other forms of the outer ring 30 are contemplated where the width and/or thickness changes around the length of the outer ring 30. The outer ring 30 may be formed with the static vanes 7, such as through a plastic molding process, or may be formed independently from the static vanes 7. In still other forms, the outer ring 30 may not be a ring but instead have a non-circular shape.

The outer ring 30 may be attached with the ventilation nozzle 2. For example, in some cooling systems 100, the ventilation nozzle 2 may be box-shaped or otherwise rectangular, and may include an opening through which fluid from the cooling system may flow towards the radiator 3. In some of these systems, the static vanes 7 may be attached to an outer ring 30, which may fit within the opening in the ventilation nozzle 2. The outer ring 30 may be attached to the ventilation nozzle in various ways, such as through welding, bolts, screws, nails, glue, moulding processes, or in various other ways. The opening of the ventilation nozzle 2 and the shape of the outer ring 30 may correspond to each other, and may be various shapes, such as circular, rectangular, oval, or various other shapes. In still other systems, the static vanes may be connected with the ventilation nozzle 2 directly, or through some other component or device. Other variations are possible.

Figure 11:
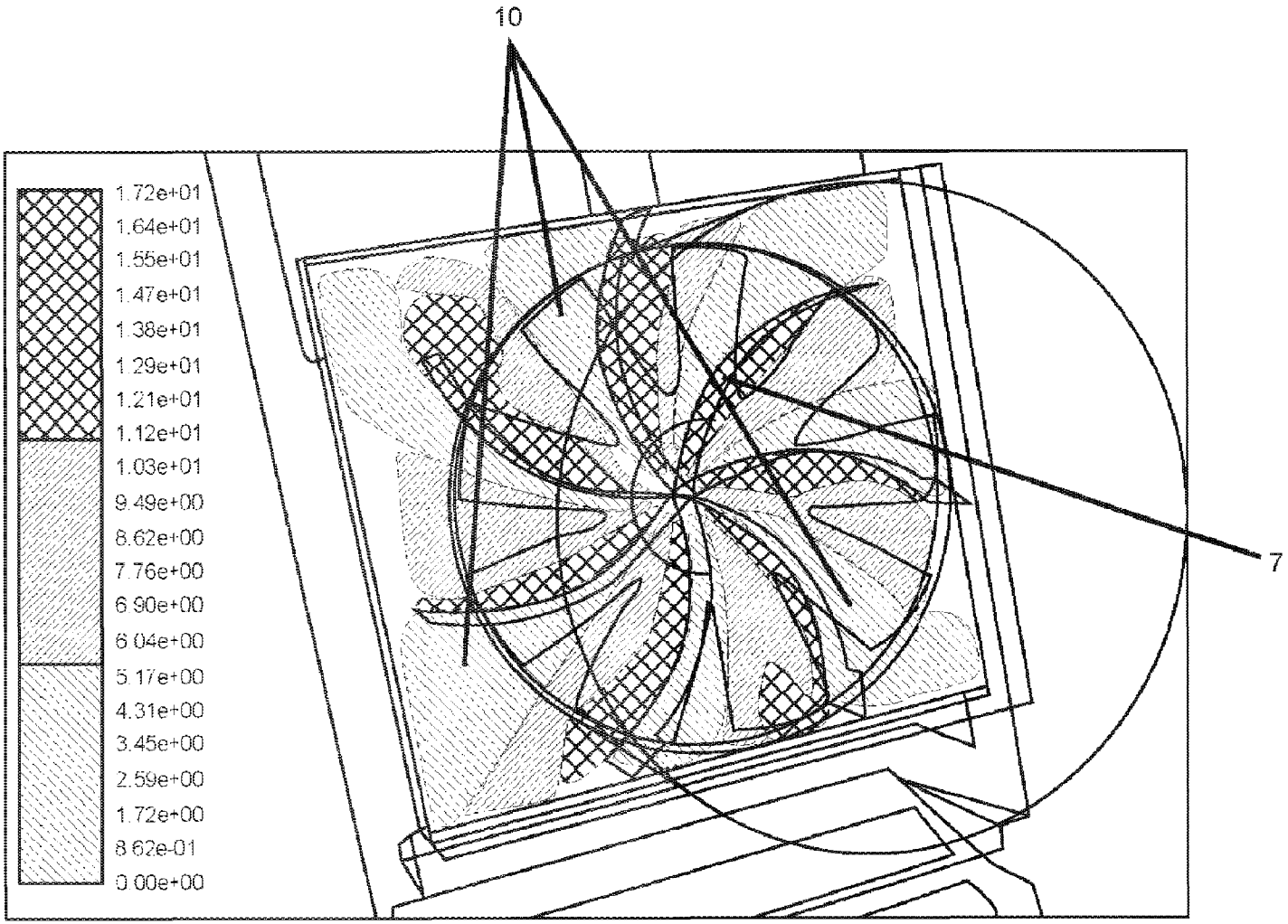
FIG. 11 shows an example cooling system with static vanes and an axial fan and distribution of fluid speeds by the cooling system.

FIG. 11 shows a distribution of fluid speeds by the cooling system with static vanes 7 and an axial fan 1. The static vanes 7 arranged in the ventilation nozzle 2 may make it possible to supply the central zone 6 with air, and may serve to cancel the inactive cone 4. In this example, the static vanes 7 introduced into the ventilation nozzle 2 may have the shape of a curved strip, perpendicular over its entire length to the plane of rotation of the mobile blades 9 of the fan 1. In some systems, the static vanes 7 have, at their distal end, a pitch angle of zero with the axis of rotation. In some of these systems, certain low pressure zones 10 (cavitation phenomenon) may form behind the static vanes 7. However, these low pressure zones 10 may be acceptable, and/or may be eliminated or reduced by inclining the distal end of the static vanes 7 to a non-zero pitch angle.

In terms of the shape and of the width of the cavitation zones 10, the static vanes 7 may be inclined at the outer end 21 by approximately 45° in relation to the axis of rotation. This pitch angle may have a degressive value, from approximately 45° at the outer end 21 of the static vanes 7, to 0° at the inner end 20 of the static vanes 7. Such a change in the inclination of the vanes from the center towards the periphery may make it possible to attenuate the degressive shape of the cavitation zones 10.

The attenuation of these cavitation zones 10 may be accentuated by modifying the shape of the static vanes 7 in order to give them a more complex aerodynamic profile. It may be considered that the static vanes 7 have a profile with a non-symmetrical section, i.e., that they have a lower surface and an upper surface of different shapes.

The shape, the number and the inclination of the static vanes 7 may be optimised in relation to the examples presented here, in such a way as to optimise the output of the cooling system 100. In particular, the static vanes 7 may have more complex shapes. The static vanes 7 may also have a relatively simple shape. A simple shape of the static vanes 7 may make it possible to lower by 3° C. the temperature in the central area 6 of the radiator 3, while still maintaining the radiator 3 at a distance from the fan 1 of only 10 to 15 cm. Other variations are possible.

Figure 13:
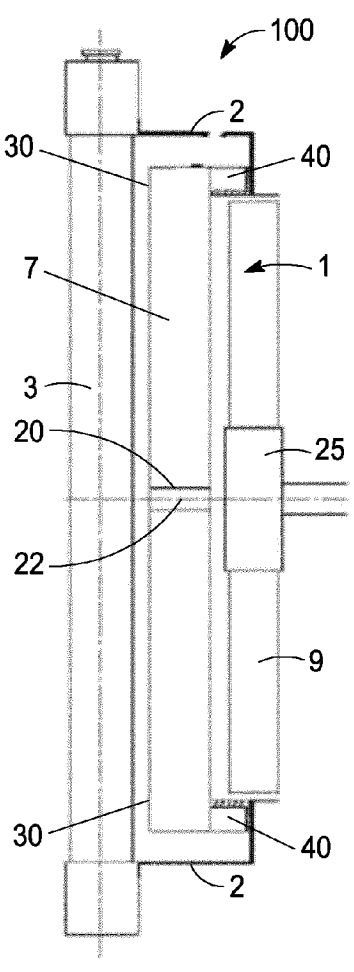
FIG. 13 shows an example cooling system with static vanes included within the shroud.
Figure 12:
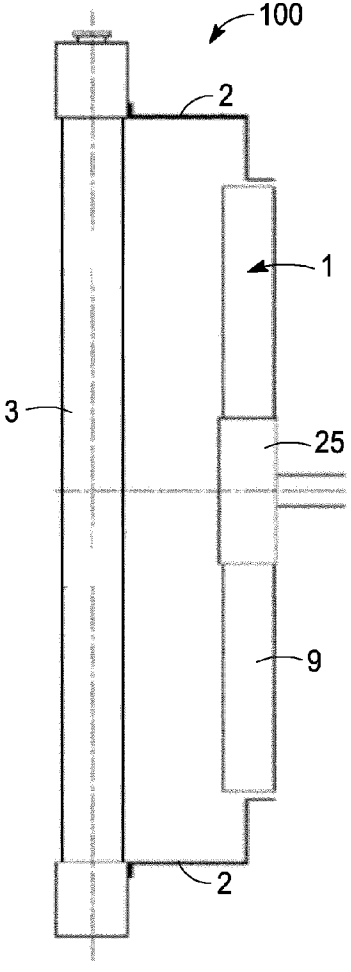
FIG. 12 shows an example cooling system that includes a shroud that surrounds the axial fan and the radiator.

FIG. 12 shows an example cooling system 100 that includes a ventilation nozzle 2 that surrounds the axial fan 1 and the radiator 3. FIG. 13 shows the cooling system 100 of FIG. 12 where the static vanes 7 have been added to the cooling system 100 within the ventilation nozzle 2. The static vanes 7 may be attached to the outer ring 30 such that the outer ring 30 may be attached to the ventilation nozzle 2 in various ways, such as through welding, bolts, screws, nails, glue, moulding processes, or in various other ways.

Figure 14:
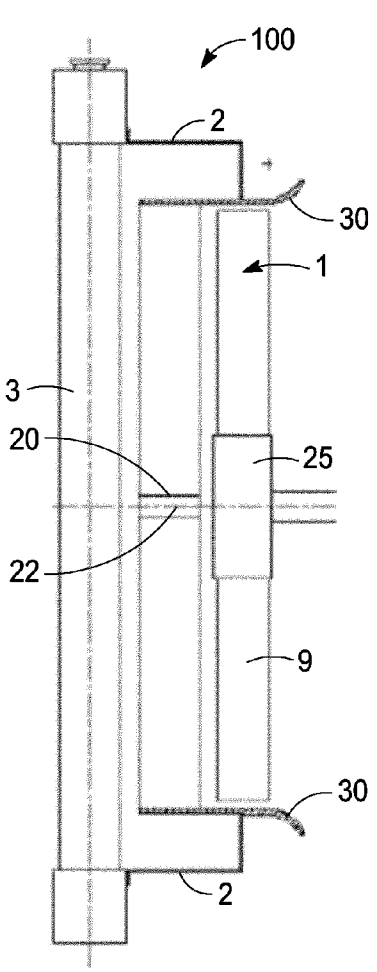
FIG. 14 shows an example cooling system with an outer ring formed around the axial fan and a venturi shape at the inlet.

FIG. 14 shows an example of the cooling system 100 where the outer ring 30 is also formed around the axial fan 1 and includes a venturi shape at the inlet. The venturi shape at the inlet may improve the air flow at the entrance of the axial fan 1 and increase efficiency of the cooling system 100. In some forms, the outer ring 30 may include some openings between each static vane 7 in order to allow the air to feed external areas radiator 3, especially when the radiator 3 as a rectangular shape. The static vanes 7, in turn, may create enough pressure in the central area 6 to force cooling air to the central area 6.

Figure 15:
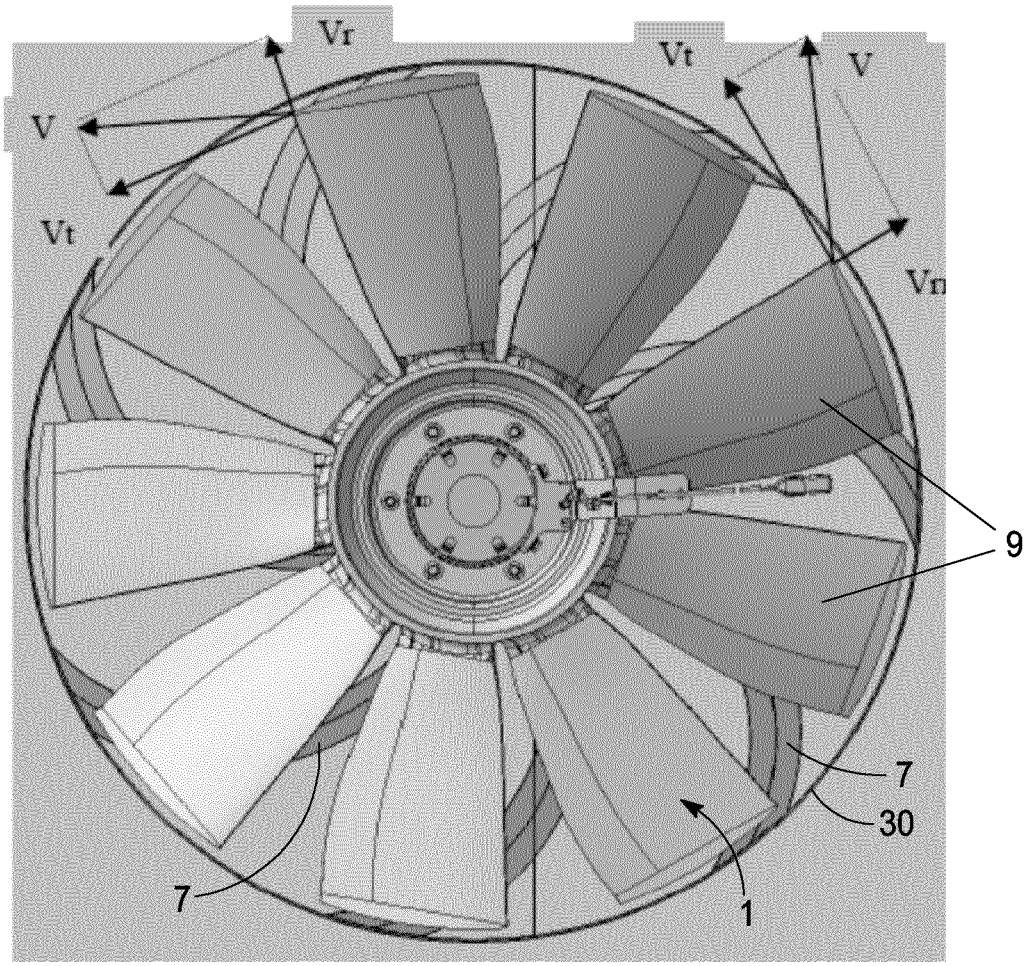
FIG. 15 shows example aerodynamic effects associated with operating an axial fan.

FIG. 15 illustrates aerodynamic effects that may be associated with operating axial fan 1. The axial fan 1 may blow air tangentially and radially towards the outside (away from the axis) by the centrifugal effect generated by the rotation speed of the blades 9. The velocity V of the air leaving the blades 9 thus may include a tangential component Vt and a radial component Vr (centrifugal). This radial component of the air velocity may result in a much higher air flow rate and a higher pressure in the peripheral zones. Conversely, the air flow and pressure are low, zero or even negative in the central area 6 of discharge. The nomenclature in FIG. 15 is indicated as follows. V=Velocity of the air out of the fan. Vt=Velocity Tangential. Vr=Velocity Radial (centrifugal effect).

Figure 16:
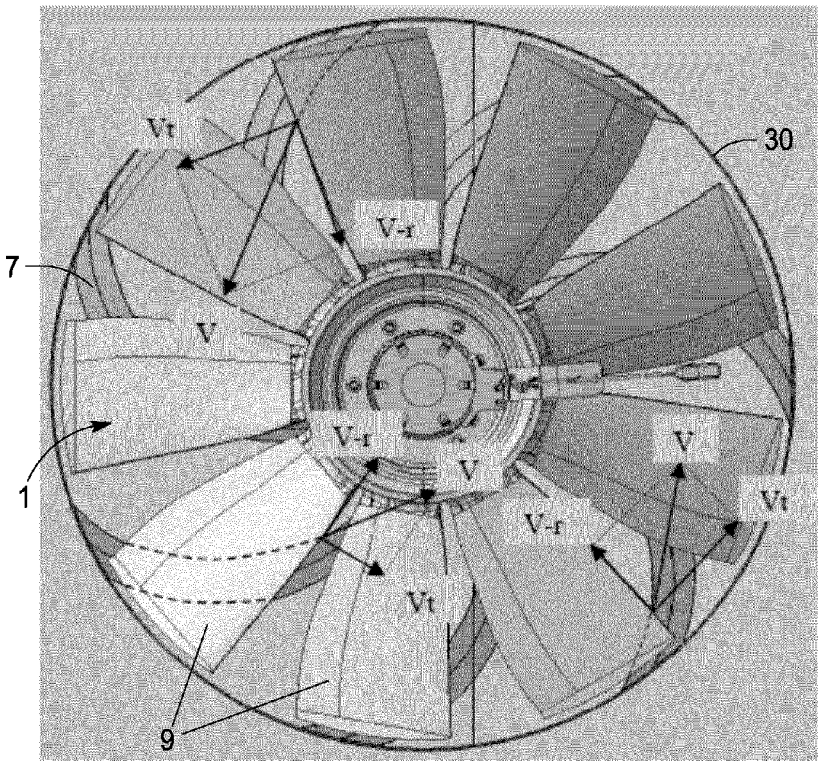
FIG. 16 illustrates shows example aerodynamic effects associated with operating an axial fan adjacent to static vanes.

FIG. 16 illustrates aerodynamic effects that may be associated with operating axial fan 1 adjacent to the static vanes 7. The curved shape of the static vanes 7 may be pronounced such that for any relative position of the axial fan 1 blades, one or more static vanes 7 is capable of converting the tangential velocity of the air flow into a radial velocity toward the central area 6. This radial velocity component may be opposed to the centrifugal velocity created by the rotation of the axial fan 1. Depending on the shape of the static vanes 7 (curvature), the intensity of the radial velocity may be equal to, or greater than, the centrifugal velocity. The curved static vanes 7 may thus both direct a radial velocity of the cooled air towards a center of the cooling device, and also direct an axial velocity of the air toward an axis of rotation of the axial fan 1.

Optimizing the shape and number of static vanes 7 may permit more equal air flow to the surface of the radiator 3 and possible pressurization of the central area 6 to provide a flow rate through the central area which is equivalent to the flow rate in the outer zones. The radial velocity that is generated by the static vanes 7 may overcome the lack of air flow in the central area 6. The static vanes 7 may improve the performance the cooling system, by placing the air flow in the direction expected to pass through the radiator. The nomenclature in FIG. 16 is indicated as follows. Vt=velocity tangential out of the fan. V=velocity of the air corrected by the static vanes 7 with the direction being tangential to the curve of static vanes 7. V-r=velocity radial toward the central area 6.

Figure 17:
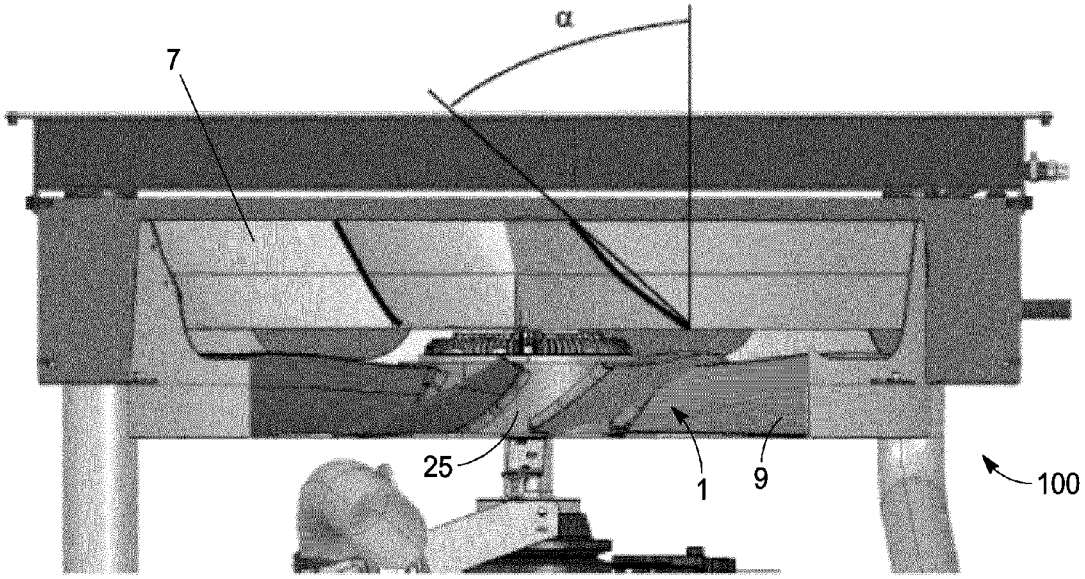
FIG. 17 illustrates shows example centripetal aerodynamic effects associated with operating an axial fan adjacent to static vanes.

FIG. 17 illustrates the centripetal aerodynamic effects associated with operating axial fan 1 adjacent to the static vanes 7. The static vanes 7 further adjust the air flow that is initially received from the axial fan 1. This further adjustment may transform the rotating air flow into axial air flow. Adjusting the air into axial air flow may improve cooling performance because the flow is adjusted into a direction that more readily passes through the radiator 3. The angle $\alpha$ formed by the direction of static vane 7 changes from a value determined to maximize the effect at the outer end 21 of each static vane 7 to 0° at the center. $\alpha$=45° was used in prototypes although this value may be optimized depending on geometries.

In some systems, the angle α formed by the rope of the fixed vane and the axis of rotation of the moving blades of the fan may gradually change a value α=0° at the proximal end of the static vanes 7 to a value α is not zero at the distal end of the static vanes 7. For example, α=45° at the distal end of the static vanes 7. In some systems, this value α and the angle and position of the static vanes 7 and mobile blades 9 can be optimized, such as using a CFD calculation.

This changing α angle of the static vanes 7 straightens the air flow and turns the tangential airflow into an axial airflow to promote penetration of the air flow into the radiator 3. This axial air flow combined with the centripetal air flow may result in improved cooling performance due to improved ventilation through all areas of the radiator 3. This axial air flow may also decrease noise generated by air friction against the fins of the radiator 3 and other features.

If there was no further adjusting of the tangential airflow into axial airflow, air may be driven in a rotational movement against the radiator 3 fins at a speed close to the fan speed. This rotational airflow against the radiator 3 fins may increase the overall noise of the cooling system 100. As an example, using the static vane 7 and outer ring 30 configurations caused the overall noise to be reduced up to 3 dB on a soundproofed 300 kVA generating set.

The axial fan 1 may have a central hub 25. The moving blades 9 may be fixed by their proximal end to the central hub 25.

The central hub 25 may be inactive with respect to the air flow because the fan blades 9 may be static on this hub 25. The axial fan 1 may have a physically inefficient area in the center where the hub 25 exists. The diameter of the hub 25 may be various sizes. In some examples, the diameter may be between 20% and 50% of the outer diameter of the blades 9 of the fan 1. In other examples, the diameter may be smaller or larger.

Therefore, in some forms of the cooling system 100, a reinforcement member for the static vanes 7 may be positioned adjacent to this central hub 25. The static vanes 7 may be connected at their proximal end to the reinforcement member. The reinforcement member may have a diameter less than or equal to the diameter of the central hub 25. The reinforcement member may thus be used to fix the static vanes 7, stiffen the vanes 7, and exploit the area behind the hub 25.

Figure 18:
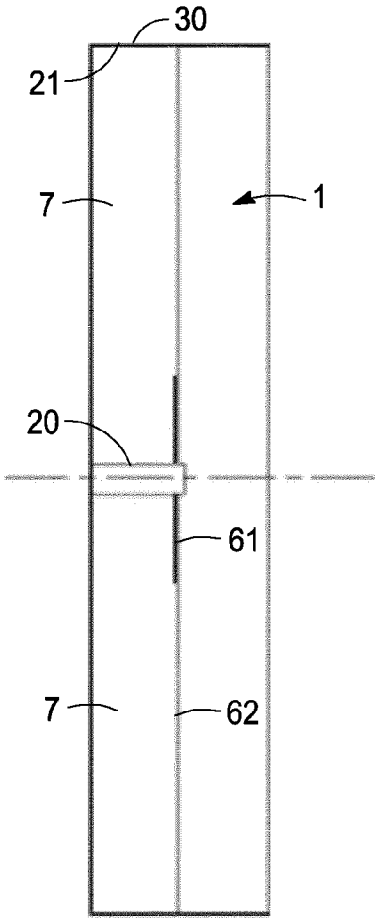
FIG. 18 shows an example reinforcement member that includes a disc.

The reinforcement member may have various shapes. As an example, FIG. 18 shows where the reinforcement member is a disc 61. The disc 61 may be secured to a front surface 62 of the static vanes 7 and may be used to reinforce the static vanes 7 in the central area 6.

In some of these systems, the reinforcement member may also include a connecting tube extending from the disc 61, on which are fixed the proximal ends of the static vanes 7. The disc 61 may be positioned close to the central hub 25. The diameter of the tube may be substantially smaller than the diameter of the disk 61, and the diameter of the disk of reinforcement may less than or equal to the diameter of the central hub 65.

Figure 19:
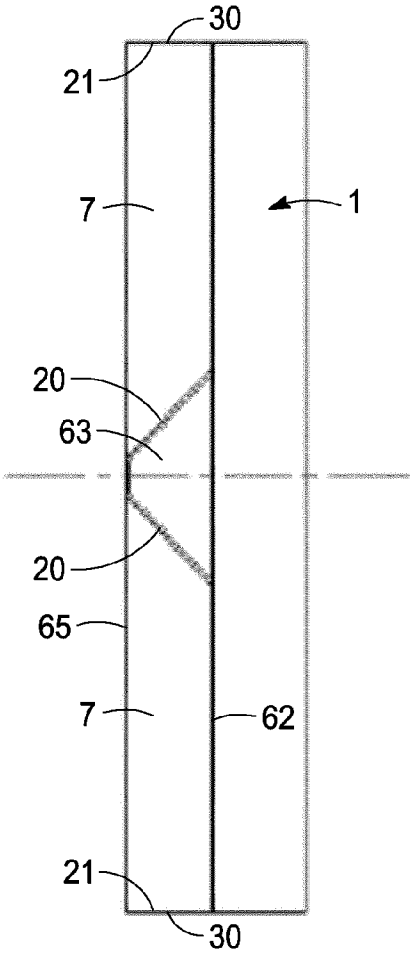
FIG. 19 shows an example reinforcement member that includes a cone.

As another example, FIG. 19 shows where the reinforcement member is a cone 63. The cone 63 may extend from a front surface 62 to a rear surface 65 of the static vanes 7 and may be used to reinforce the static vanes 7 in the central area 6. In some variations, the reinforcement member may be substantially cone-shaped or cone-curved surface, the diameter of which decreases away from the central hub to the element to be cooled.

Figure 20:
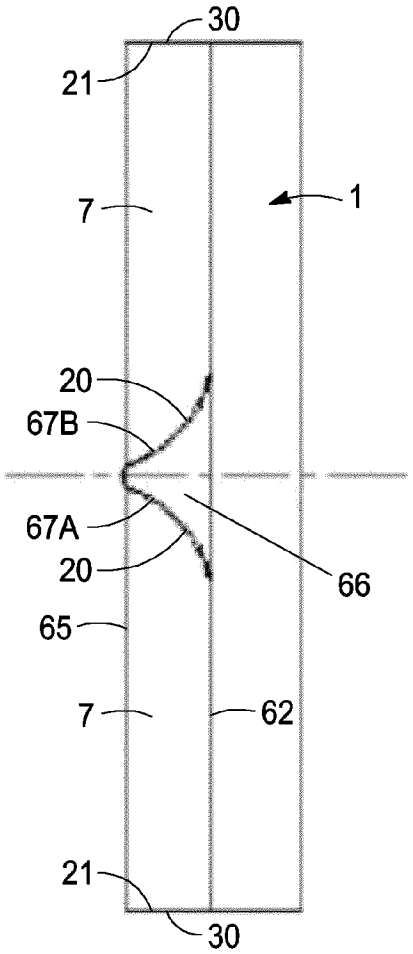
FIG. 20 shows an example reinforcement member that includes a cone with curved surfaces.

As another example, FIG. 20 shows where the reinforcement member is a cone 66 with curved surfaces 67A, 67B. The cone 66 may extend from a front surface 62 to a rear surface 65 of the static vanes 7 and may be used to reinforce the static vanes 7 in the central area 6. The static vanes 7 may be fixed in their proximal end to the cone of the reinforcement member, which may serve the dual role of the connecting means and stiffening. The diameter of the cone may be equal to or less than that of the hub 25 of the fan 1. The use of a central cone, and especially with a curved surface, may facilitate the reorientation of the centripetal flow toward the axial direction desired and sought for passing cooling air through the beam in the central area of the radiator.

The example reinforcement members shown in FIGS. 19 and 20 may make it easier to manufacture the static vanes from plastic using some form of molding process. In some cooling systems 10, the diameter of the reinforcement member may be the same as or smaller than the diameter of the hub 25 for the respective axial fan 1 that is adjacent to reinforcement member. In various other forms, the reinforcement member may have a different diameter.

The reinforcement member may provide a way for fixing the static vanes 7 to each other. The reinforcement member may also stiffen the assembly of the static vanes 7. Systems with a reinforcement member having a diameter that is less than or equal to the diameter of the central hub 25 may not worsen the appearance of the inactive area of the axial fan 1, and may not degrade an inward rectifying effect.

Figure 21:
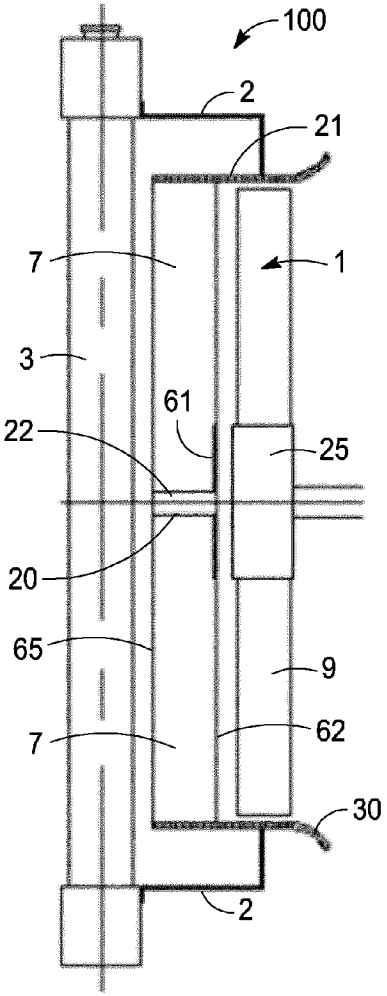
FIG. 21 shows the static vane and disc configuration of FIG. 18 being used in a cooling system.

The diameter of the reinforcement member on back side of the static vanes 7 may need to be as small as possible in order to enable the air flow to feed the central area of the radiator 3. FIG. 21 shows the static vane 7 and disc 61 configuration of FIG. 18 being used in a cooling system 100.

Figure 22:
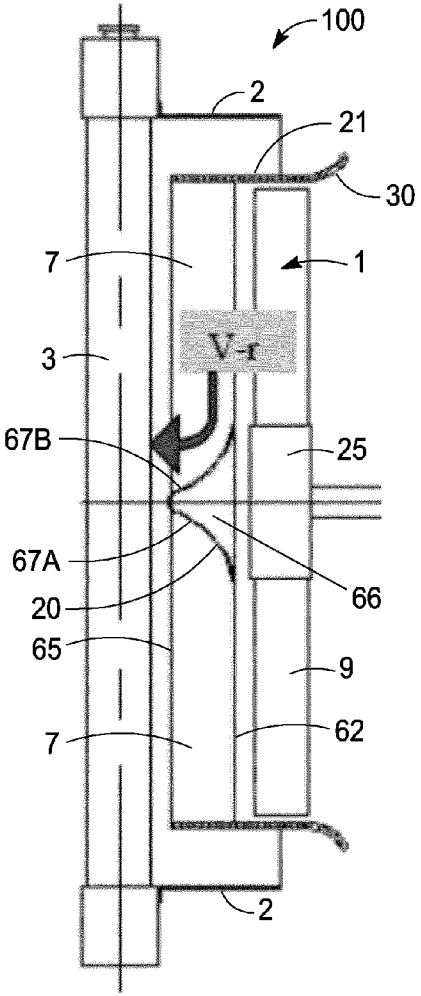
FIG. 22 shows the static vane and cone configuration of FIG. 20 being used in a cooling system.

FIG. 22 shows the static vane 7 and cone 66 with curved surfaces 67A, 67B configuration of FIG. 20 being used in a cooling system 100. In some cooling systems 100, using the cone 66 with curved surfaces 67A, 67B may efficiently redirect the centripetal air flow velocity into an axial air flow velocity at the inner end 20 of the static vanes 7. This airflow redirection may facilitate passing air flow through the central area radiator 3.

The shape of the reinforcement member that is used with the static vanes 7 may be optimized for each application. As examples, the diameter of the reinforcement member may be based on (i) the hub 25 diameter in the corresponding axial fan 1; (ii) CFD calculations; and/or (iii) test results.

Figure 23:
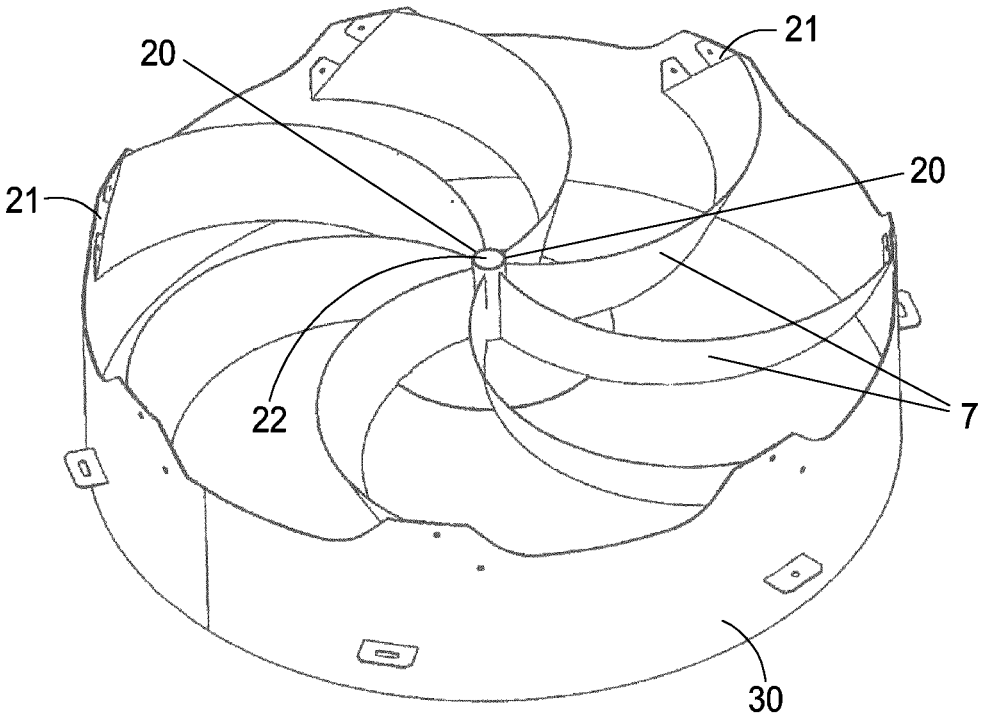
FIG. 23 shows an example configuration for the static vanes and the outer ring.

FIG. 23 illustrates another example configuration for the static vanes 7 and the outer ring 30. The static vanes 7 and the outer ring 30 may be different sizes in order to match with the standard diameters of fans that may be used (e.g., 18", 21", 23", 27", 28", 32", 35", or other diameters) depending on the needs of the cooling system 100.

The cooling system may include at least one axial fan with at least two rotatable blades, capable of driving a cooling fluid, through a ventilation nozzle, to an element to be cooled. The cooling system may also include at least two fixed blades disposed facing the movable blades in the ventilation nozzle. The fixed vanes may have a curved shape adapted to convert a tangential velocity component of said cooling fluid driven by said axial fan. The curved vanes may, on the one hand, direct a radial velocity of the fluid towards the center of said cooling device, and on the other hand, direct an axial velocity of the fluid toward an axis of rotation of the fan.

In some systems, the moving blades may be fixed in their proximal end to a central hub. The fixed vanes may be connected at their proximal end to a connecting device of less than or equal to the diameter of said hub central. In some systems, the connecting device may include a tube on which are fixed the proximal ends of the fixed vanes and a disc reinforcement located adjacent the central hub. The diameter of the tube may be substantially smaller than the diameter of the disk reinforcement, and the diameter of the disk reinforcement may be being less than or equal to the diameter of said central hub. In some systems, the connecting device has a substantially cone-shaped or cone-curved surface, the diameter of which decreases away from said central hub to said cooling.

In some systems, the fixed vanes may have a curvature within a plane substantially perpendicular to an axis of rotation of the moving blades, called the plane of rotation. In some systems, the distal end of the fixed vanes may have a non-zero angle with respect to the axis of rotation. In some systems, the fixed blades are twisted.

Some systems may include a number N of fixed blades and a number P of moving blades of the fan. In some systems, N and P may be coprime numbers. In some systems, the fixed vanes may be connected at their distal end in a substantially annular member having a diameter greater than the diameter of the axial fan. The substantially annular member may have a tapered shape on a portion extending upstream of the axial fan so as to create a Venturi effect on the cooling fluid. In some systems, the cooling system may be included as part of a generator having an engine and an alternator (or generator) connected to the engine, capable of converting electrical energy received from the engine. Other variations are possible.

The cooling systems 100 described herein may (i) provide an efficient existing cooling system such that the cooling system may be able to reach a designated cooling target; (ii) minimize the cost and size of the radiator 3 while maintaining adequate cooling performance; (iii) decrease the overall size, or footprint, of the cooling system 100 while maintaining adequate cooling performance; (iv) permit decreased axial fan speed while maintaining adequate cooling performance thereby decreasing noise generated by the axial fan 1; and/or (v) decrease the energy required to operate the axial fan 1. Systems with static vanes 7 arranged in the ventilation nozzle 2 may produce two fan airflow combined effects: first, they may allow adjustment of centripetal flow of the cooling fluid, so as to remove an inactive cone and provide a flow of air through the dead zone behind a hub of the fan 1, and second, they may counteract the rotation of the cooling air caused by the ripple effect of the fan blades 9. Their By placing the static vanes 7 in the ventilation nozzle 2, downstream of the fan 1 relative to the direction of movement of the cooling air, may increase the efficiency of the fan 1.

The description and the drawings herein illustrate examples systems. Other example systems may incorporate structural, logical, electrical, process, and other changes. Portions and features of some systems may be included in, or substituted for, those of other alternative systems. Although the description presented here is in the particular context of cooling heat engines of generating sets, the cooling systems 100 may be used with other applications in other technical fields. For example, the cooling systems 100 may be used to cool engines used in other applications, separate from generators. Other variations are possible.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate example. While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A generator system comprising:

an engine;

an alternator driven by the engine to generate electrical power;

a radiator connected to the engine;

an axial fan that directs air toward the radiator to cool the radiator;

a plurality of static vanes located between the axial fan and the radiator, wherein the plurality of static vanes each includes an outer end having a member, which attaches said static vane to an outer ring, where each member extends in a direction of a rotation axis of the axial fan between said outer ring and said static vane, and wherein the static vanes have a zero pitch angle at an inner end of the static vanes and a non-zero pitch angle at the outer end of the static vanes, where a pitch angle is an angle formed by a chord of the static vane and the rotation axis of the axial fan.

2. The generator system of claim 1, wherein each member is integrally formed with the outer ring and each member is integrally formed with the respective static vane.

3. The generator system of claim 1, further comprising a reinforcement member extending from a front surface of each static vane to a back surface of each static vane.

4. The generator system of claim 3, wherein the reinforcement member is a cone with curved surfaces extending from said front surface of each static vane to said back surface of each static vane.

5. The generator system of claim 1, wherein the axial fan is at least partially inside of the outer ring.

6. The generator system of claim 1, wherein a center of the outer ring lies along a longitudinal axis of the axial fan.

7. The generator system of claim 1, wherein the entire inner end of each of the static vanes has a zero pitch angle formed by a chord of the static vane and the rotation axis of the axial fan.

8. A cooling assembly for cooling an engine in a generator, the cooling assembly including:

an axial fan that directs air toward a radiator of said engine to cool the radiator;

a plurality of static vanes located between the axial fan and the radiator, the plurality of static vanes each including an inner end that is joined to an inner end of each of the other static vanes, the plurality of static vanes each including an outer end having a member that attaches said static vane to an outer ring, where each member extends in a direction, of a rotation axis of the axial fan between said outer ring and said static vane, wherein the static vanes have a zero pitch angle at the inner end of the static vanes and a non-zero pitch angle at the outer end of the static vanes, where a pitch angle is an angle formed by a chord of the static vane and the rotation axis of the axial fan, each member being integral with the outer ring and the respective static vane, the axial fan being at least partially inside of the outer ring.

9. The cooling assembly of claim 8, wherein the static vanes are curved to direct air received from the axial fan toward said rotation axis of the axial fan via centripetal effect, the static vanes having a curvature included in a plane substantially perpendicular to said rotation axis of the axial fan.

10. The cooling assembly of claim 8, wherein the entire inner end of each of the static vanes has a zero pitch angle formed by a chord of the static vane and the rotation axis of the axial fan.

* * * * *